US006526710B1

(12) United States Patent
Killen

(10) Patent No.: US 6,526,710 B1
(45) Date of Patent: Mar. 4, 2003

(54) FLOORING SYSTEM

(76) Inventor: Andrew Killen, 218 Scenic Dr., Merewether Heights NSW 2291 (AU)

( * ) Notice: Subject to any disclaimer, the term of this patent is extended or adjusted under 35 U.S.C. 154(b) by 0 days.

(21) Appl. No.: 09/529,841

(22) PCT Filed: Oct. 23, 1998

(86) PCT No.: PCT/AU98/00883

§ 371 (c)(1),
(2), (4) Date: Jun. 19, 2000

(87) PCT Pub. No.: WO99/22096

PCT Pub. Date: May 6, 1999

(30) Foreign Application Priority Data

Oct. 23, 1997 (AU) ..... P0 9978

(51) Int. Cl.[7] ..... E04C 2/52; E04F 15/00

(52) U.S. Cl. ..... 52/220.1; 52/220.2; 52/220.5; 52/177; 52/105; 52/585.1

(58) Field of Search ..... 52/220.1, 220.2, 52/126.6, 220.5, 220.3, 177, 105, 585.1; 428/174

(56) References Cited

U.S. PATENT DOCUMENTS

| | | | | | |
|---|---|---|---|---|---|
| 2,559,198 | A | * | 7/1951 | Ogden | 52/220.1 X |
| 3,040,388 | A | * | 6/1962 | Conn | 52/585.1 X |
| 3,512,324 | A | * | 5/1970 | Reed | 52/585.1 X |
| 4,028,858 | A | * | 6/1977 | Rehbein | 52/585.1 X |
| 4,566,235 | A | | 1/1986 | Groll | 52/220 |
| 5,082,712 | A | | 1/1992 | Starp | 428/95 |
| 5,263,289 | A | * | 11/1993 | Boyd | 52/220.2 |
| 5,489,462 | A | * | 2/1996 | Sieber | 248/174 |
| 6,076,315 | A | * | 6/2000 | Kondo | 52/220.1 |
| 6,189,283 | B1 | * | 2/2001 | Bentley et al. | 52/585.1 X |

FOREIGN PATENT DOCUMENTS

| | | | | | |
|---|---|---|---|---|---|
| DE | 3601240 | | | 6/1986 | E04F/19/08 |
| DE | 8908172 | U1 | | 5/1989 | |
| DE | 4222936 | A1 | | 1/1994 | |
| EP | 111763 | A1 | | 11/1983 | |
| EP | 0263583 | | | 8/1987 | E04B/5/48 |
| EP | 0377263 | A1 | | 8/1990 | |
| JP | 3-93959 | A | * | 4/1991 | 52/220.3 |
| JP | 3-224955 | A | * | 10/1991 | 52/220.3 |
| JP | 5-106327 | A | * | 4/1993 | 52/220.3 |
| JP | 9242309 | | | 9/1997 | E04F/15/024 |

* cited by examiner

*Primary Examiner*—Carl D. Friedman
*Assistant Examiner*—Brian E. Glessner
(74) *Attorney, Agent, or Firm*—James Ray & Associates

(57) ABSTRACT

A flooring system includes a board (6) having a lower surface (2) in which arcuate grooves (3) are formed. Grooves (3) are arranged in a grid, having points of intersection (5). Each groove (3) extends from one edge of the board to the opposite edge of the board. The grooves serve to enable the passage of electrical wire which might be used for telephones, computers, hi-fi systems or other applications. The system makes such cabling unobtrusive and is particularly suitable where access to an under floor area is limited or non-existent.

31 Claims, 1 Drawing Sheet

FLOORING SYSTEM

TECHNICAL FIELD

The present invention relates generally to floors and to boards which can be laid to form a floor. In one form the invention relates particularly to boards used to form a hollow supporting floor surface with a sub-layer for concealment of electrical and other conduits and will primarily be described with reference to that context. It should be remembered, however, that the invention has broader use in conduit concealment applications for walls and ceilings to provide a safe means of accessing electrical cables and hydraulic connections.

BACKGROUND OF THE INVENTION

It is common in many businesses and homes to have a number of electricity, telephone and/or computer wires running along the floor. These wires are obtrusive and can be dangerous. It is also often preferable for such connections to be separated from one another rather than allowing the electromagnetic radiation from one cable to interfere with the current in another, for example between power and data communication lines. However, it is often difficult to hide these wires as access to an under-floor area may be limited or non-existent. Further, if such wires are housed under a floor, it is necessary to drill holes in the floor to provide access for the wires to the appliance to which connection is required. This makes it difficult to move the appliances to which the wires are connected.

Access or ducted flooring systems that provide space for wires, cables etc are known in the art. These flooring systems are often of significant depth, which reduces the floor to ceiling height in the room above, and requires a step into the room having the flooring system. Such floors are often heavy and/or difficult to move. Examples are disclosed in DE 3601240 A, U.S. Pat. No. 5,082,712

WO88/03207 describes a modular floor panel system with integral ducting in which the panels are detachably joined by a system of convex and concave dimples integrally formed on the vertical sides of the panels. Several alternative connecting means, each incorporated on the sides of the floor panels, are suggested. Such connecting means are designed to allow vertical displacement and detachment of the panels to allow their removal from the floor deck on which they are placed. U.S. Pat. No. 4,566,235 describes a tongue and groove interlocking engagement system integrally formed by the shape of the vertical sides of adjacent tile blocks or using resilient joining members inserted into slots or openings in adjacent sections of the tile blocks in order to provide a non-rigid, elastic and moveable floor panel system.

SUMMARY OF THE INVENTION

In a first aspect the present invention provides a flooring system including:

a board having a substantially planar upper surface and a lower surface having at least one groove formed therein, with at least one side wall extending between the upper surface and the lower surface, and at least one groove extending from an edge of the lower surface to another edge of the lower surface, the or each groove being sized to receive at least one wire or cable;

the board further including one or more discrete recesses located in the at least one side wall; and one or more respective inflexible connecting elements, each adapted for insertion in a respective recess and further adapted for being inserted into a recess of an adjacent board in use of the system to interlock the boards to restrict their displacement relative to each other.

When the terminology "discrete recess(es)" is used herein it is a reference to a recess having an opening at the side wall that is completely surrounded by the side wall. This contrasts with a longitudinal groove which has the disadvantages as described above.

Preferably the boards are placed such that at least one groove is aligned with a groove of another board.

Preferably the or each board is substantially rectangular or square in shape.

Preferably the or each groove is straight and extends from an edge of the lower surface to an opposite edge of the lower surface of the or each board.

Preferably each board in the system has a plurality of grooves which are arranged in a grid. The grid may or may not be uniform, depending on the application required.

Preferably each groove is substantially arched or arcuate in profile.

Preferably each board has four side walls with least one recess in each side thereof, each recess being adapted to receive the element, the element being also received in a recess of an adjacent like board to restrict vertical and/or horizontal displacement of the boards relative to each other when positioned.

Preferably the element is an elongate member. Most preferably the elongate member is a dowel.

Preferably markings are applied to the upper surface of each board to indicate the location of said grooves and/or the junctions between intersecting grooves.

Preferably each board is made from particle board, plywood, or a dense plastics material.

In a second aspect the present invention provides a method for installing a flooring system as per the first aspect comprising the steps of:

(a) laying a plurality of the boards on an existing floor or structure with the boards placed such that at least one groove is aligned with a groove of another board; and (b) aligning at least one side recess with another recess of an adjacent board to enable the insertion of the inflexible connecting element in both recesses.

Preferably the method further comprises the step of running at least one wire, cable or the like through at least one groove of the boards.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
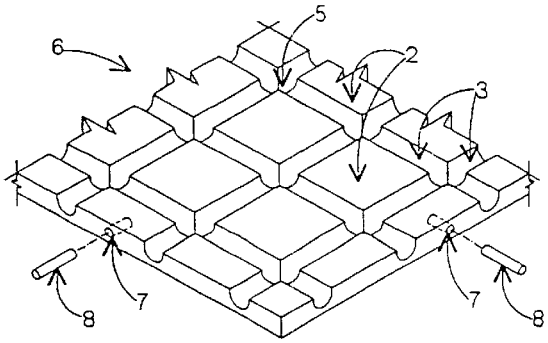
FIG. 1 is an isometric view of the underside of a board.

Referring to FIG. 1, a board 6 is shown in isometric view from underneath. The board 6 comprises a lower surface 2 in which arcuate grooves 3 are formed. In the preferred embodiment shown, the grooves 3 are arranged in a grid, having points of intersection 5 (this arrangement effectively breaks the lower surface into a plurality of lower surfaces which are clearly seen in FIG. 1). Each groove 3 extends from one edge of the board to the opposite edge of the board in a straight line. However, it is possible in accordance with the invention to arrange the grooves 3 in other patterns such as, for example, an uneven grid, a diagonal grid or even to provide curved grooves (not shown). The arched tops of the grooves 3 transfer any load to the lower flat surfaces 2 of the board which support the upper surface 1 of the board. In some applications, a flat top of the grooves 3 may also be suitable.

Figure 4:
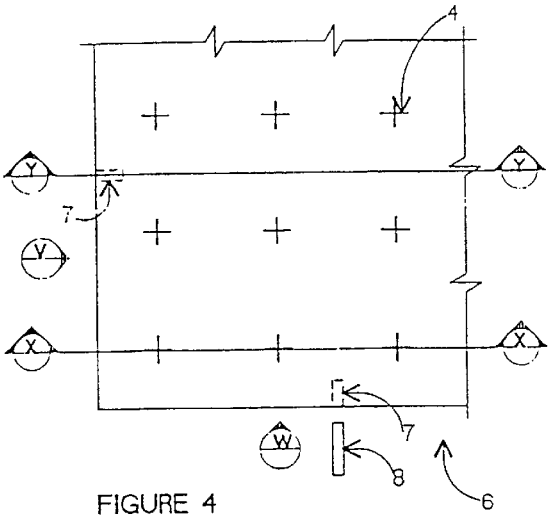
FIG. 4 is a plan view of the board of FIG. 1 viewed from above.
Figure 2:
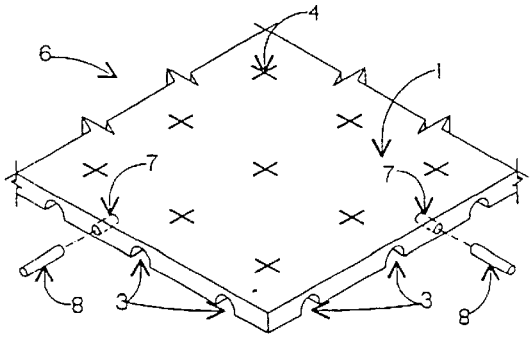
FIG. 2 is an isometric view of the board of FIG. 1 viewed from above.

Referring to FIGS. 2 and 4, the board 6 comprises a substantially flat upper surface 1. The cross shaped markings 4 (or other markings such as symbols or diagrams) are applied in ink or transfer motifs to indicate the grooves or the junction of the grooves which are underneath the board 6. These marks are to assist the user to located the wires or cables which are housed below in the grooves 3, for when access to said wire or cable is required. The space within the grooves 3 can be accessed for use or maintenance by drilling an access hole through any part of the upper surface or platform directly above the grooves.

Figure 3:
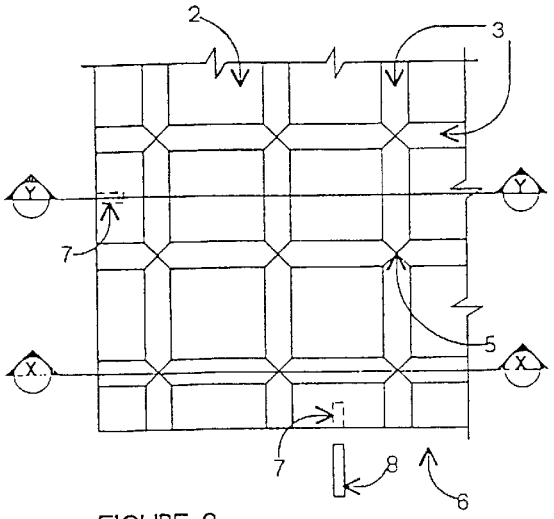
FIG. 3 is a plan view of the underside of the board of FIG. 1.

Referring to FIG. 3, the lower surface of a board is shown. The X-shaped markings indicate the junctions where each groove intersects another groove.

Figure 5:
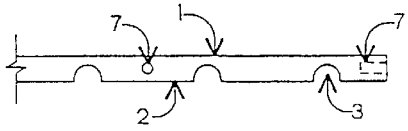
FIG. 5 is a side view of the board of FIG. 1 from direction V shown in FIG. 4.
Figure 6:
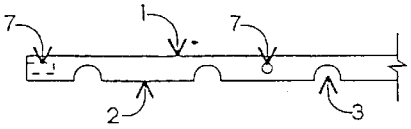
FIG. 6 is a side view of the board of FIG. 1 from direction W shown in FIG. 4.

FIGS. 5 and 6 show two edges of a board 6, showing how the grooves 3 extend to the edge of the board. When the boards are installed alongside one another to make a floor, the grooves 3 line up with one another to form a continuous cavity for a service wire or the like. It can be seen that the edges of the board are substantially vertical, so that each board can neatly abut the adjacent board when installed.

Figure 7:
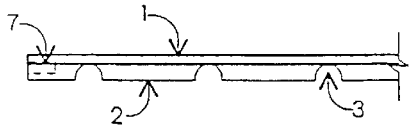
FIG. 7 is a cross section of the board of FIG. 1 through line X—X.
Figure 8:
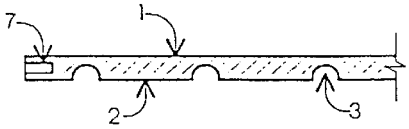
FIG. 8 is a cross section of the board of FIG. 1 through line Y—Y.

FIGS. 7 and 8 are cross sections through lines X—X and Y—Y respectively, showing the preferred relative depth of the board.

Figure 9:
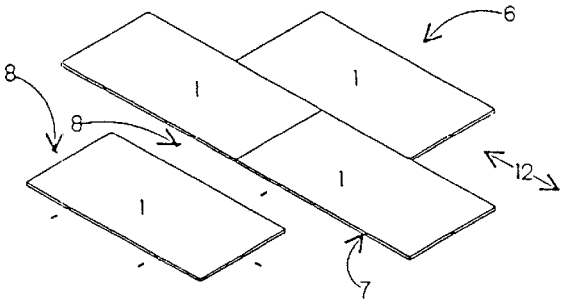
FIG. 9 is an isometric view of part of an assembled flooring system when viewed from above.

FIG. 9 shows a partial view of a flooring system. The flooring system comprises a plurality of boards 6 arranged in a staggered fashion relative to one another. The staggered arrangement of the boards assists in preventing the boards from being displaced relative to one another so as to keep the grooves (not shown in FIG. 9) under the boards in alignment. To prevent the boards from slipping in the direction of arrows 12, recesses 7 are put into the sides of each board. Dowels 8 are placed within these recesses 7. Alternative means of interlocking the boards, such as pins, can also be suitable and fall within the scope of the claimed invention.

Although shown as a substantially square shape, it is preferred that each board 6 is 900 mm×1800 mm. Existing flat flooring can be purchased in lengths of 3600 mm×1800 mm. To manufacture the board 6, a piece of flat board having these dimensions is cut in half and half again and the grooves bored therein. Boards of 1200 mm×2400 mm or 600 mm×1200 mm are also acceptable. It is preferred that the entire thickness of the board is 18, 19, 22 or 25 mm, which are the thicknesses of commercially available board. For 18 mm flooring, the preferred groove depth is 12 mm. For 19 mm flooring, the preferred groove depth is 13 mm. For 22 mm flooring the preferred depth is 16 mm. For 25 mm flooring, the preferred groove depth is 19 mm. This leaves 6 mm of board thickness above the apex of each groove to provide the requisite strength of the board. It is also preferred that each groove is approximately 25 mm in width. The preferred grid size is 60, 120 or 390 mm between the centres of each adjacent groove. The grid may not be uniform, depending on the application, but may comprise groups of grooves, each group being separated from each other by a predetermined spacing. It is further preferred that each groove 3 has vertical parallel sides and a curved semicircular top to form a substantially arch shaped groove. However, it is foreseen that the boards can be manufactured in different sizes so as to cover the required floor area of a building or structure.

The above described flooring system has many advantages. The board can be quite thin, as described above, to allow for the required service line, wire or cable to pass through the grooves, and the remainder of the board. This is advantageous where a step in the floor is not desirable or possible. Further, no legs or edge frames are required. It is also advantageous where the floor to the ceiling height in a building is minimal and a thicker platform would cause problems. Further, because the board is thin it is also lightweight, easy to move and easy to install. The boards themselves can be made from particle board, plywood, or a dense plastics material, although other materials can also be suitable and fall within the scope of the claimed invention.

A flooring system using the boards need not be fixed to the existing floor as it is a "floating" or "raft" installation. Services can be installed, taken out and reinstalled any number of times to suit the changing requirements of a building or structure. It also allows for the installation of any floor covering over the assembly of boards without special modifications.

Previously it has not been appreciated that such an improvement to sub-floor layer conduit concealment apparatus can prevent any vertical or horizontal displacement and detachment of the panels in instances where the security of the conduits is of importance and the prevention of tampering with in-place systems is required. For example such a flooring system can enhance safety by substantially removing the possibility of accidental electrocution. Previous sub-floor apparatus available for this purpose is not sufficiently interlocked to prevent access once installed. Also, previous sub-floor layer conduit concealment apparatus can be subject to 'creep' where the boards may move relative to one another whereas, in the present system, the nature of the interlocking reduces this possibility. A sub-floor conduit concealment system will not work if sufficient relative movement of the boards can occur.

In particular, U.S. Pat. No. 4,566,235 referred to earlier describes a board interlocking engagement system where elastic or resilient joining members are inserted into slots or openings in adjacent boards to fulfil a "gasket" type function. This allows relative movement of the boards, whereas the present invention specifically refers to a rigid floor overlay system made using inflexible connectors in discrete recesses on the sides of the boards to hold and lock the boards into place. In fact the prior art U.S. Pat. No. 4,566,235 can only provide a rigid system when cement, mortar, grout or other adhesive is applied between boards, which is not required in the present invention.

Further, the use of an elastic joining strip shown in U.S. Pat. No. 4,566,235 can mean that the boards are held wide enough apart that a gap remains between adjacent boards as stated. To prevent tampering with the sub-floor conduits and to avoid the use of cement it is preferable to use inelastic linkages which allow the sides of the boards to closely adjoin.

Significantly the kind of grooves used for fitting joining strips claimed in U.S. Pat. No. 4,566,235 can provide a longitudinal weakness in the edges of a floor panel which can therefore increase the risk of damage occurring in manufacturing, transportation and installation of the boards, particularly when using thin boards as described in this invention. If the tongue and groove edge of a board becomes damaged, the board becomes useless since tongue and groove depends on continuous longitudinal engagement. A dowel recess, however, is far less likely to experience such damage when contained in the side of a board. If a dowel recess is damaged, another dowel recess can be inserted adjacent to the original, keeping the board as a useful item.

Further, the use of dowels in recesses as linkages conveniently allows boards to be cut to facilitate their installation into areas smaller in size than a normal module of board. In use it is rare that a whole number of boards can be placed across a given width of a floor dimension without the need of a narrower board at some point. A recess for a dowel can be readily machined in-situ in the side of a cut-down board.

It should be noted that the invention described can also be suitable for ceilings, walls and other like applications.

Whilst the invention has been described with reference to several preferred embodiments it should be appreciated that the invention can be embodied in many other forms.

What is claimed is:

1. A flooring system including:

a board having a substantially planar upper surface and a lower surface, and at least one groove extending from an edge of the lower surface to another edge of the lower surface, the or each groove being sized to receive at least one cable;

the board further including at least one discrete recess located in the at least one side wall; and at least one inflexible connecting element, each inflexible connecting element adapted for insertion in a respective one of the recesses and further adapted for being inserted into one of the recesses of an adjacent board in use of the system to interlock the boards to restrict their displacement relative to each other such that the inflexible connecting element alone interlocks adjacent boards and when in use is concealed from view at the planar upper surface in a manner so as to prevent access to that element.

2. The flooring system as claimed in claim 1 wherein the boards are placed such that the at least one groove is aligned with a groove of another board.

3. The flooring system as claimed in claim 2 wherein the or each board is substantially rectangular or square in shape.

4. The flooring system as claimed in claim 3 wherein the or each groove is straight and extends from an edge of the lower surface to an opposite edge of the lower surface of the or each board.

5. The flooring system as claimed in claim 4 wherein each board in the system has a plurality of grooves which are arranged in a grid.

6. The flooring system as claimed in claim 5 wherein each groove is substantially arched or arcuate in profile.

7. The flooring system as claimed in claim 1 wherein each board has four side walls with the least one recess in each side thereof, each of the recesses being adapted to receive the inflexible connecting element, the inflexible connecting element being also received in one of the recesses of an adjacent like board to restrict at least one of a vertical and a horizontal displacement of the boards relative to each other when positioned.

8. The flooring system as claimed in claim 7 wherein the inflexible connecting element is an elongate member.

9. The flooring system as claimed in claim 8 wherein the elongate member is a dowel.

10. The flooring system as claimed in claim 9 wherein markings are applied to the upper surface of each board to indicate at least one of the location of the grooves and the junctions where one of the grooves intersects with another of the grooves.

11. The flooring system as claimed in any one of the preceding claims wherein each board is made from particle board, plywood, or a dense plastics material.

12. The flooring system as claimed in claim 1 wherein the or each board is substantially rectangular or square in shape.

13. The flooring system as claimed in claim 1 wherein the or each groove is straight and extends from an edge of the lower surface to an opposite edge of the lower surface of the or each board.

14. The flooring system as claimed in claim 2 wherein the or each groove is straight and extends from an edge of the lower surface to an opposite edge of the lower surface of the or each board.

15. The flooring system as claimed in claim 1 wherein each board in the system has a plurality of grooves which are arranged in a grid.

16. The flooring system as claimed in claim 2 wherein each board in the system has a plurality of grooves which are arranged in a grid.

17. The flooring system as claimed in claim 3 wherein each board in the system has a plurality of grooves which are arranged in a grid.

18. The flooring system as claimed in claim 1 wherein each groove is substantially arched or arcuate in profile.

19. The flooring system as claimed in claim 2 wherein each groove is substantially arched or arcuate in profile.

20. The flooring system as claimed in claim 3 wherein each groove is substantially arched or arcuate in profile.

21. The flooring system as claimed in claim 4 wherein each groove is substantially arched or arcuate in profile.

22. The flooring system as claimed in claim 1 wherein markings are applied to the upper surface of each board to indicate at least one of the location of the grooves and the junctions where one of the grooves intersects with another of the grooves.

23. The flooring system as claimed in claim 2 wherein markings are applied to the upper surface of each board to indicate at least one of the location of the grooves and the junctions where one of the grooves intersects with another of the grooves.

24. The flooring system as claimed in claim 3 wherein markings are applied to the upper surface of each board to indicate at least one of the location of the grooves and the junctions where one of the grooves intersects with another of the grooves.

25. The flooring system as claimed in claim 4 wherein markings are applied to the upper surface of each board to indicate at least one of the location of the grooves and the junctions where one of the grooves intersects with another of the grooves.

26. The flooring system as claimed in claim 5 wherein markings are applied to the upper surface of each board to indicate at least one of the location of the grooves and the junctions where one of the grooves intersects with another of the grooves.

27. The flooring system as claimed in claim 6 wherein markings are applied to the upper surface of each board to indicate at least one of the location of the grooves and the junctions where one of the grooves intersects with another of the grooves.

28. The flooring system as claimed in claim 7 wherein markings are applied to the upper surface of each board to indicate at least one of the location of the grooves and the junctions where one of the grooves intersects with another of the grooves.

29. The flooring system as claimed in claim 8 wherein markings are applied to the upper surface of each board to indicate at least one of the location of the grooves and the junctions where one of the grooves intersects with another of the grooves.

30. A method for installing a flooring system, said method comprising the steps of:

(a) providing a board having a substantially planar upper surface and a lower surface having at least one groove formed therein, with at least one side wall extending between the upper and the lower surfaces and at least one groove extending from an edge of the lower surface to another edge of the lower surface, the or each groove being sized to receive at least one cable, the board further including at least one discrete recess located in the at least one side wall;

(b) providing at least one inflexible connecting element, each inflexible connecting element adapted for insertion in one of the recesses and further adapted for being inserted into one of the recesses of an adjacent board in use of the system to interlock the boards to restrict their displacement relative to each other such that the element alone interlocks the adjacent boards;

(c) laying a plurality of the boards of an existing floor with the boards placed such that the at least one groove is aligned with one of the grooves of another board; and (d) aligning the recess in the at least one side wall of one of the boards with another of the recesses of an adjacent board to enable the insertion of the inflexible connecting element in both recesses such that the inflexible connecting element in use is concealed from view at the planar upper surface in a manner so as to prevent access to that element.

31. The method as claimed in claim 30 further comprising the step of running the at least one cable through at least one groove of the boards.

* * * * *